US009267372B2

(12) United States Patent
Clark et al.

(10) Patent No.: US 9,267,372 B2
(45) Date of Patent: Feb. 23, 2016

(54) REPLACEABLE ARBOR TOOL HOLDER FOR REPLACEABLE IMPACT TOOLS

(71) Applicants: Cedric J. Clark, St. Maries, ID (US); Ryan L. Clark, St. Maries, ID (US); Travis L. Clark, St. Maries, ID (US)

(72) Inventors: Cedric J. Clark, St. Maries, ID (US); Ryan L. Clark, St. Maries, ID (US); Travis L. Clark, St. Maries, ID (US)

( * ) Notice: Subject to any disclaimer, the term of this patent is extended or adjusted under 35 U.S.C. 154(b) by 0 days.

(21) Appl. No.: 13/671,458

(22) Filed: Nov. 7, 2012

(65) Prior Publication Data

US 2013/0119746 A1 May 16, 2013

Related U.S. Application Data

(60) Provisional application No. 61/628,988, filed on Nov. 10, 2011.

(51) Int. Cl.
*E01C 23/088* (2006.01)
*E21C 35/18* (2006.01)
*E21C 35/19* (2006.01)

(52) U.S. Cl.
CPC ..... *E21C 35/18* (2013.01); *E01C 23/088* (2013.01); *E21C 2035/191* (2013.01)

(58) Field of Classification Search
USPC ..... 299/39.8, 79.1, 102, 106, 108
See application file for complete search history.

(56) References Cited

U.S. PATENT DOCUMENTS

| | | | | |
|---|---|---|---|---|
| 4,068,897 | A * | 1/1978 | Amoroso | 299/102 |
| 5,038,440 | A * | 8/1991 | Demuth et al. | 19/114 |
| 6,213,560 | B1 * | 4/2001 | Lindblom | 299/39.4 |
| 7,810,888 | B2 | 10/2010 | Clark et al. | |
| 2005/0098331 | A1 * | 5/2005 | Edwards | 172/701.3 |

FOREIGN PATENT DOCUMENTS

| | | | |
|---|---|---|---|
| DE | 3644601 | A1 * | 7/1988 |
| JP | 2008008318 | A * | 1/2008 |

OTHER PUBLICATIONS

Machine Translation of JP 2000008318 Dec. 23, 2014.*

* cited by examiner

*Primary Examiner* — Sunil Singh
(74) *Attorney, Agent, or Firm* — Seed IP Law Group PLLC

(57) ABSTRACT

A replaceable arbor tool holder for replaceable impact tools provides a base structurally carrying a tool holder for a replaceable impact tool. The base is arcuate and the tool holder is structurally interconnected to a top surface of the base. A medial channel is defined in the tool holder to releasably carry an impact tool. The tool holder converts impact forces upon the impact tool into frictional forces along a line tangent to the circumference of the arbor when the tool holder is fastened to the rotating arbor.

7 Claims, 10 Drawing Sheets

REPLACEABLE ARBOR TOOL HOLDER FOR REPLACEABLE IMPACT TOOLS

RELATED APPLICATIONS

This Utility Patent Application claims the benefit of earlier filed U.S. Provisional Patent Application No. 61/628,988 titled BOLT-ON ARBOR TOOL HOLDER FOR REPLACEABLE IMPACT TOOLS filed on Nov. 10, 2011. The entire contents of aforementioned U.S. Provisional Patent Application No. 61/628,988 are incorporated herein by this reference.

FIELD OF INVENTION

This invention relates to hard material disintegration machines and more particularly to a replaceable holder for impact tools for use with rock crushers and scarifiers having rotating arbors for crushing, grinding, scarifying and milling.

BACKGROUND AND DESCRIPTION OF PRIOR ART

Rock crushers, scarifiers and like machines are essential for building, maintaining and reconditioning roads but have various inherent drawbacks including rapid arbor wear, rapid tooling implement wear, limited tooling implement mounting patterns and they are typically configured to either crush and break fracturable material such as rock or concrete, or they are alternatively configured to grind and mill softer abrasive materials such as asphalt.

Rock crushers and milling/scarifying machines typically carry a large rotating arbor that has a plurality of tooling implements thereon. The arbor is interconnected with a power source that provides rotational motion to the arbor. The tooling implements carried on the arbor are affixed thereto, generally permanently such as by welding, or machining directly into an outer circumferential surface of the arbor. As the arbor rotates, the tooling implements impact the material being worked upon causing the breaking/fracturing or milling/scarifying.

Arbors are typically massive structures having a fixed geometry that limits how the machine carrying the arbor may be used, what type of material it may be used upon and the characteristics of the finished product. For instance, an arbor configured to fracture rock and other hard materials typically cannot be used to effectively grind asphalt because of the dramatically different characteristics of rock and asphalt. Although rock and concrete are hard and are difficult to fracture, these materials are not overly abrasive. On the other hand, materials such as asphalt and sandstone are not overly hard or difficult to fracture, but these materials are hugely abrasive leading to tremendous wear and heat buildup on the arbor and tooling implements. Different tooling implements and different configurations of tooling implements are necessary for the proper grinding, milling and fracturing of each material. Arbors are complex structures and because they are subject to such enormous amounts of wear and tear any improvement that increases longevity and/or flexibility and/or adaptability is desirable.

What is needed is an apparatus that allows a variety of tooling implements to be releasably fastened onto an arbor to allow differing uses of the arbor and also to allow individual tooling implement replacement. The apparatus must be attachable to a variety of arbors and be able to carry tooling implements for fracturing, breaking, milling, planing, crushing, pulverizing as well as scarifying. Further, because the tooling implements carried upon the arbor suffer from such tremendous wear and tear, the apparatus must make replacement of the tooling implements easy with minimal amounts of down time and minimal amounts of maintenance. The apparatus should make the machine adaptable to particular site needs.

Because rock crushing, grinding, scarifying and milling operations exert so much wear and tear and destructive forces on equipment and apparatus, fastening methods that are normally considered to be structural or permanent, such as welding, are not necessarily structural or permanent in this industry. It is known and recognized in rock crushing, grinding, scarifying and milling operations that components welded to a rotating arbor are replaceable and are regularly replaced by cutting the component off and re-welding replacement component in the removed component's location. For purposes of this patent disclosure, a component welded to an arbor is replaceable.

Our replaceable arbor tool holder for replaceable impact tools overcomes various of the aforementioned drawbacks and resolves various of the aforementioned needs by providing a replaceable arbor tool holder for impact tools that allows tool replacement and machine reconfiguration for application to varying materials.

Our invention has an arcuate base structurally carrying an impact tool holder on an outer surface. The tool holder is configured to carry a replaceable impact tool such as a carbide tipped impact tool. The base is releasably connected to an arbor by plural bolts extending through the base and engaging with the arbor thereunder.

Our invention does not reside in any one of the identified features individually but rather in the synergistic combination of all of its structures, which give rise to the functions necessarily flowing therefrom as hereinafter specified and claimed.

Some or all of the problems explained above, and other problems, may be helped or solved by the invention shown and described herein. Our invention may also be used to address other problems not set out herein or which become apparent at a later time. The future may also bring to light unknown benefits which may be in the future appreciated from the novel invention shown and described herein.

SUMMARY

A replaceable arbor tool holder for replaceable impact tools provides a base structurally carrying a tool holder for a replaceable impact tool and the base is releasably connectable to an arbor with bolts. The base is arcuate having a convex top surface and an opposing bottom surface. The tool holder is structurally interconnected to the top surface of the base and has gussets at a leading edge portion providing additional structural integrity to the interconnection with the base. Bolt holes are defined in the base proximate first and second end portions for mounting bolts to extend therethrough to engage with the arbor. A medial channel is defined in the tool holder to releasably carry an impact tool. The impact tool has a shank carrying a carbide tip, a shaft extending from the shank opposite the tip, and a retainer ring groove defined in a circumferential surface of the shaft opposite the shank for releasable engagement of a C-ring retainer. The structure of the tool holder converts impact forces on the carbide tip into frictional forces along a line tangent to a circumference of the arbor.

In providing such a replaceable arbor tool holder it is:

a principal object to provide a tool holder that allows replacement of impact tools.

a further object to provide a tool holder that is releasably fastenable to an arbor.

a further object to provide a tool holder that allows customization of arbor impact tooling patterns.

a further object to provide a tool holder that allows customization of rock crushing and milling arbors.

a further object to provide a tool holder that is capable of use with abrasive materials such as, but not limited to, asphalt and sandstone.

a further object to provide a tool holder that is usable with off-the-shelf impact tools.

a further object to provide a tool holder that is replaceable.

a further object to provide a tool holder that converts impact forces into friction forces.

a further object to provide a tool holder that minimizes down time of rock crushing arbors.

a further object is to provide a tool holder that is releasably fastenable on top of an arbor protector.

a further object is to provide a tool holder that is configured to allow staggering of tool holder mountings.

a further object to provide a tool holder that transfers impact forces into shearing forces along a line tangent to a circumference of the arbor.

a further object to provide a tool holder that may be installed cooperatively with other types of impact tooling.

a still further object to provide a replaceable arbor tool holder for replaceable carbide tools that is of new and novel design, of rugged and durable nature, of simple and economic manufacture and one that is otherwise well suited to the uses and purposes for which it is intended.

Other and further objects of our invention will appear from the following specification and accompanying drawings which form a part hereof. In carrying out the objects of our invention it is to be understood that its structures and features are susceptible to change in design and arrangement with only one preferred and practical embodiment of the best known mode being illustrated in the accompanying drawings and specified as is required.

BRIEF DESCRIPTIONS OF DRAWINGS

Specific forms, configurations, embodiments and/or diagrams relating to and helping to describe preferred versions of the invention are explained and characterized herein, often with reference to the accompanying drawings and figures. The drawings and figures and all features shown herein also serve as part of the disclosure of the invention of the current application whether described in the text or by graphical disclosure. Such drawings and figures are briefly described below.

DESCRIPTION OF PREFERRED EMBODIMENT

Introductory Notes

Figure 1:
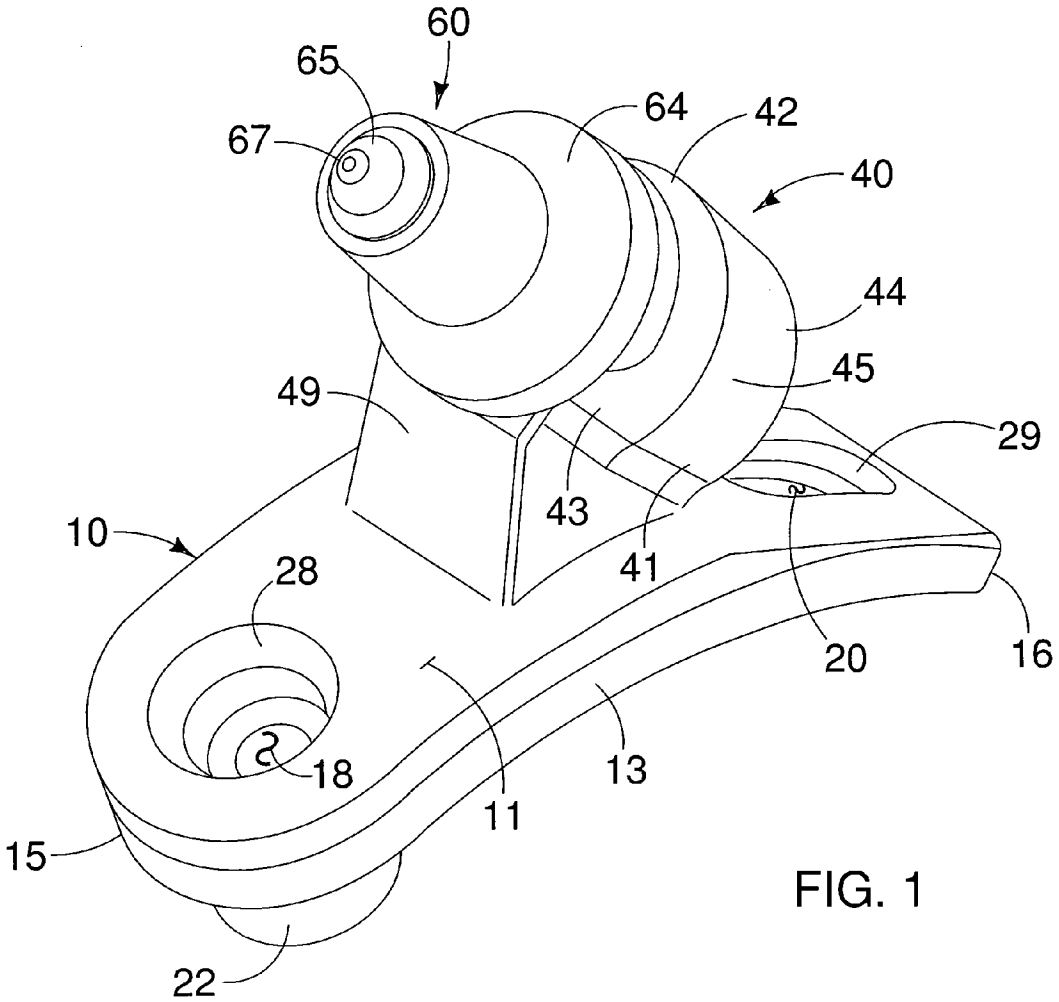
FIG. 1 is an isometric leading end, top and first side view of our replaceable tool holder carrying a carbide tipped conical shank impact tool.
Figure 2:
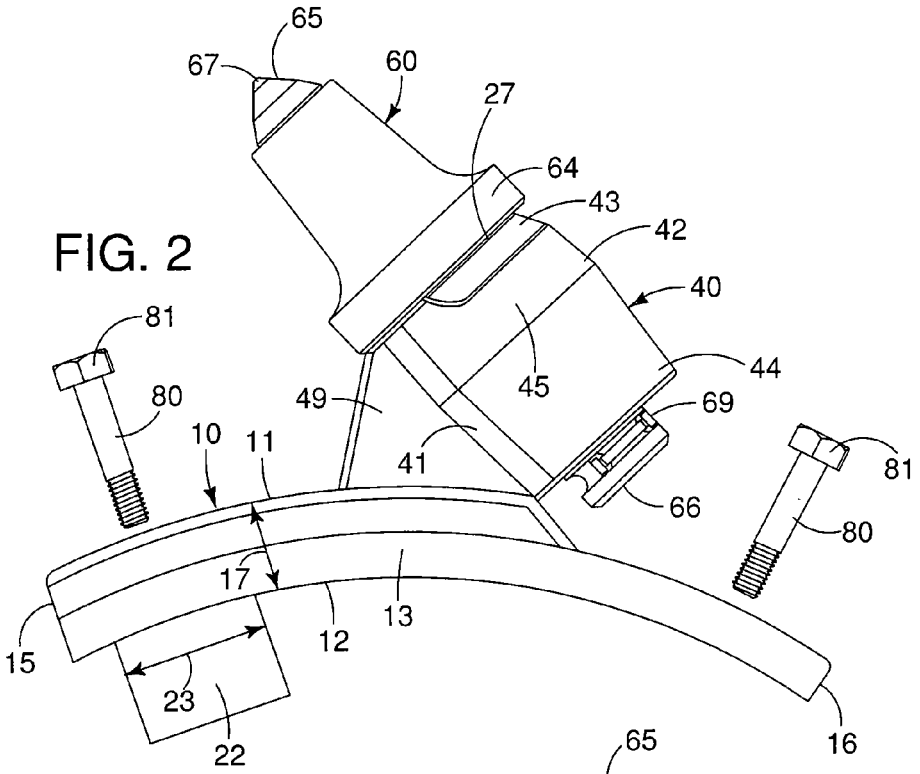
FIG. 2 is an orthographic first side view thereof.
Figure 3:
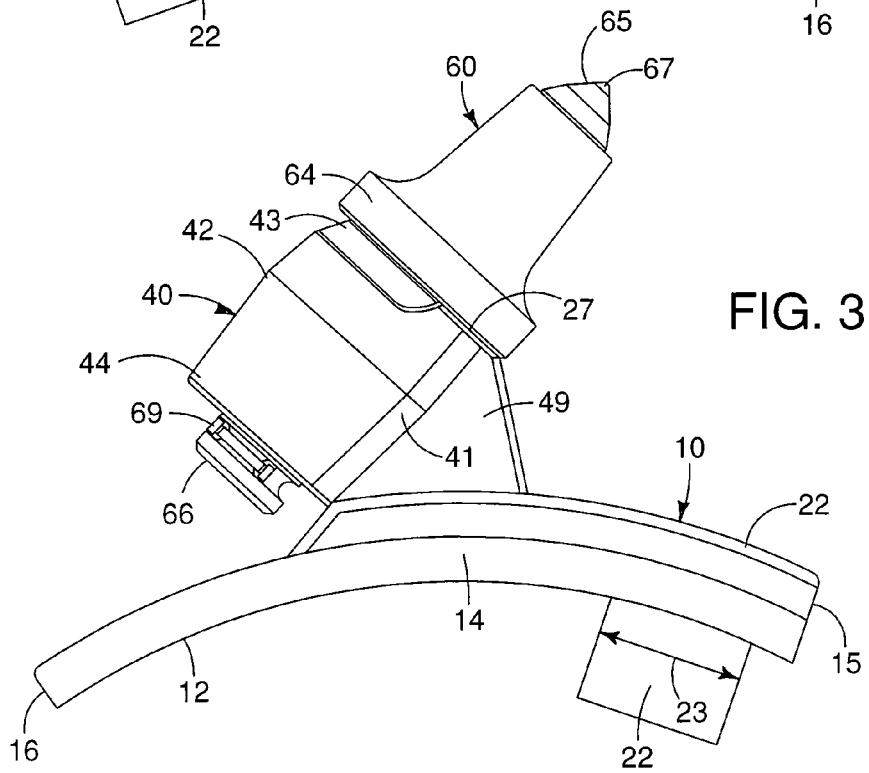
FIG. 3 is an orthographic second side view thereof.
Figure 5:
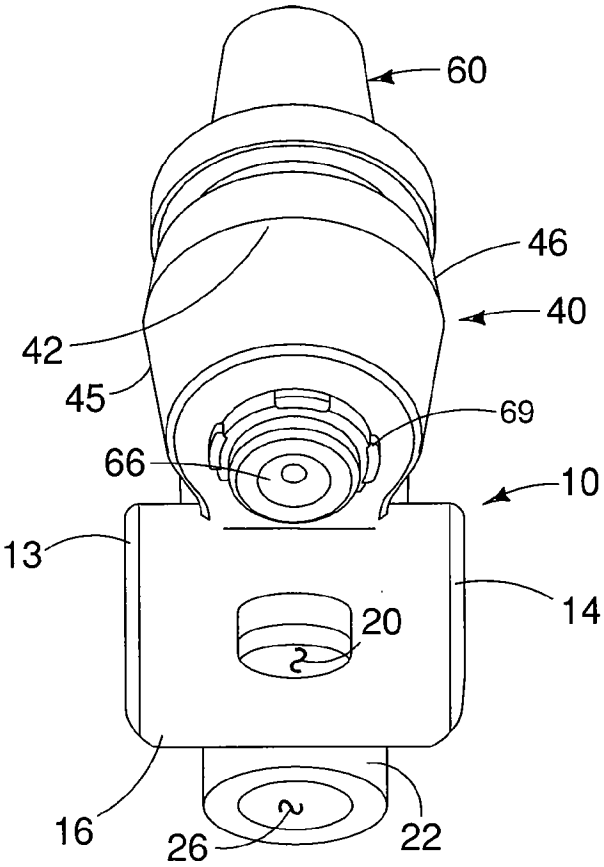
FIG. 5 is an orthographic trailing end view thereof.
Figure 4:
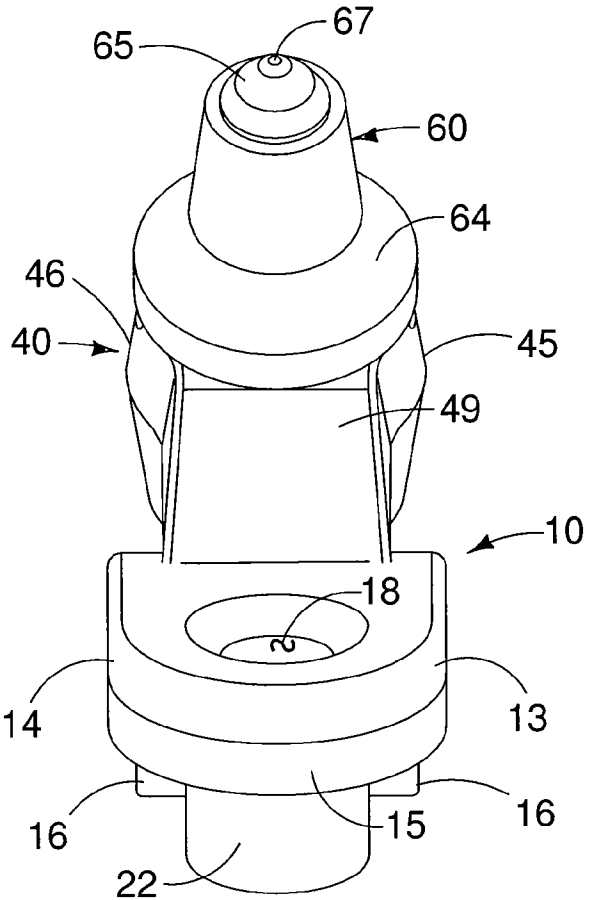
FIG. 4 is an orthographic leading end view thereof.

The readers of this document should understand that the embodiments described herein may rely on terminology used in any section of this document and other terms readily apparent from the drawings and figures and the language common therefore as may be known in a particular art and such as known or indicated or provided by dictionaries. Widely known dictionaries used in the preparation hereof are *Webster's Third New International Dictionary* (© 1993), *The Oxford English Dictionary* (Second Edition, © 1989), *The New Century Dictionary* (© 2001-2005) and the *American Heritage Dictionary of the English Language* ($4^{th}$ Edition © 2000) all of which are hereby incorporated by this reference for interpretation of terms used herein, and for application and use of words defined in such references to more adequately or aptly describe various features, aspects and concepts shown or otherwise described herein.

This document is premised upon using one or more terms or features shown in one embodiment that may also apply to or be combined with other embodiments for similar structures, functions, features and aspects of the invention. Wording used in the claims is also descriptive of the invention and the text of both the Claims and the Abstract are incorporated by reference into the description entirely.

OVERVIEW OF THE APPARATUS

As used herein, the term "bottom", its derivatives, and grammatical equivalents refers to a portion of our replaceable arbor tool holder that is proximate to a supporting arbor. The term "top", its derivatives, and grammatical equivalents refers to a portion of our replaceable arbor tool holder that is distal from the supporting arbor. The term "rearward", its derivatives, and grammatical equivalents refers to a trailing edge portion of our replaceable arbor tool holder. The term "forward", its derivatives, and grammatical equivalents refers to a leading edge portion of our replaceable arbor tool holder. The term "outer", its derivatives, and grammatical equivalents refers to a lateral side portion of our replaceable arbor tool holder as opposed to a laterally medial portion.

Our replaceable arbor tool holder for replaceable impact tools generally provides an arcuate base 10 structurally carrying a tool holder 40 for a replaceable impact tool 60. The base 10 is releasably connectable to an arbor 83 of a rock crushing machine (not shown).

The base 10 is preferably formed of hardened steel and is somewhat rectilinear and arcuate in shape having a top surface 11, a bottom surface 12, a first lateral edge 13, a second lateral edge 14, a leading end portion 15 and a trailing end portion 16. A thickness 17 is defined between the top surface 11 and the bottom surface 12. The top surface 11 is somewhat convex in shape from the leading end portion 15 to the trailing end portion 16 and the bottom surface 12 is somewhat concave in shape from the leading end portion 15 to the trailing end portion 16. A front bolt hole 18 is defined in the base 10 spacedly adjacent the leading end portion 15 and generally medially between the first lateral edge 13 and the second lateral edge 14. The front bolt hole 18 has a diameter 19 and is countersunk 28 adjacent the top surface 11 to receive and protect a head portion 81 of mounting bolt 80. A bolt bushing 22 is structurally carried on the bottom surface 12 of the base 10 about the front bolt hole 18 and the bolt bushing 22 defines a medial channel 26 that communicates with the front bolt hole 18 so that the mounting bolt 80 may extend simultaneously through the base 10 and through the medial channel 26 of the bolt bushing 22 to threadably engage with a threaded hole (not shown) defined in the arbor 83.

Figure 6:
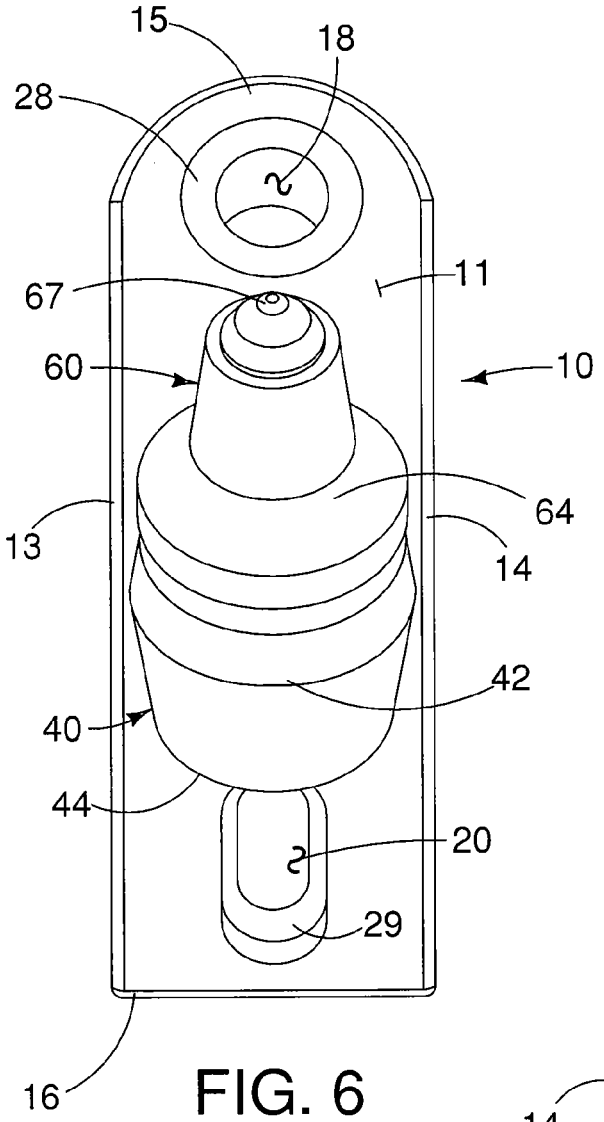
FIG. 6 is an orthographic top, downward looking view thereof.
Figure 7:
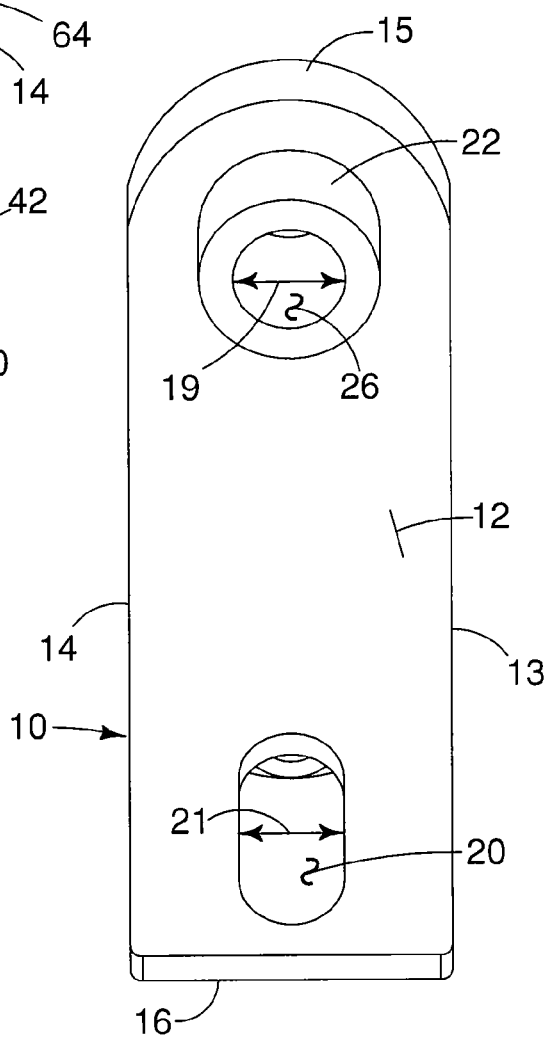
FIG. 7 is an orthographic bottom, upward looking view thereof.

Rear bolt hole 20 is defined in the base 10 proximate the trailing end portion 16 and generally medially between the first lateral edge 13 and the second lateral edge 14. In the preferred embodiment the rear bolt hole 20 has a diameter 21 and is somewhat elongated front to back (FIG. 6) to accommodate different diameter arbors 83 and to ease engagement of mounting bolts 80 with the arbor 83. The positions of the front bolt hole 18 and bolt bushing 22 and the rear bolt hole 20 align with corresponding radially aligned threaded bolt holes (not shown) defined in the arbor 83. The rear bolt hole 20 may also be counter sunk 29 adjacent the top surface 11 of the base 10 if desired to protect the head portion 81 of the mounting bolt 80.

The tool holder 40, which may be referred to in the industry as a "block", is structurally attached to the top surface 11 of the base 10. The tool holder 40 is somewhat barrel-like in shape and has a top portion 42 distal from the base 10, a bottom portion 41 proximate the base 10, a leading end portion 43, a trailing end portion 44, a first lateral side 45, a second lateral side 46 and defines an axially aligned medial channel (not shown) communicating between the leading end portion 43 and the trailing end portion 44 between the top portion 42 and bottom portion 43 and between the first and second lateral sides 45, 46 respectively. A shoulder 27 is formed around an opening orifice (not shown) to the medial channel (not shown) at the leading end portion 43. Gussets 49 structurally communicate between the top surface 11 of the base 10 and the leading end portion 43 of the tool holder 40 to provide additional structural integrity to the interconnection of the tool holder 40 to the base 10.

The impact tool 60 is releasably engageable with the tool holder 40 which supports the impact tool 60 during use. A variety of impact tools 60 may be releasably interconnected with the tool holder 40 as desired by a user for a variety of materials and uses. For purposes of this patent disclosure, the preferred impact tool 60 is conical tipped impact tool such as the type used for milling operations, however it is to be understood that other tools may also be engaged with the tool holder 40 and are contemplated and anticipated by this patent disclosure. The impact tool 60 has a generally cylindrical somewhat elongated shaft 61 structurally carrying a radially enlarged shank 64 at a first end portion 65 and defines a circumferentially extending retainer ring groove 68 spacedly adjacent a second end portion 66. The shank 64 is preferably conical in shape having a tip 67 opposite the shaft 61 and in the preferred embodiment, the tip 67 is carbide for strength and durability. When carried within the tool holder 40, the shaft 61 extends through the medial channel (not shown) defined by the tool holder 40 and the shank 64 frictionally communicates with the shoulder 27 of the tool holder 40 while the second end portion 66 of the shaft 61 extends outwardly from the medial channel (not shown) at the trailing end portion 44 of the tool holder 40. A C-ring retainer 69 is releasably engaged with the retainer ring groove 68 to positionally maintain the impact tool 60 in engagement with the tool holder 40.

Figure 8:
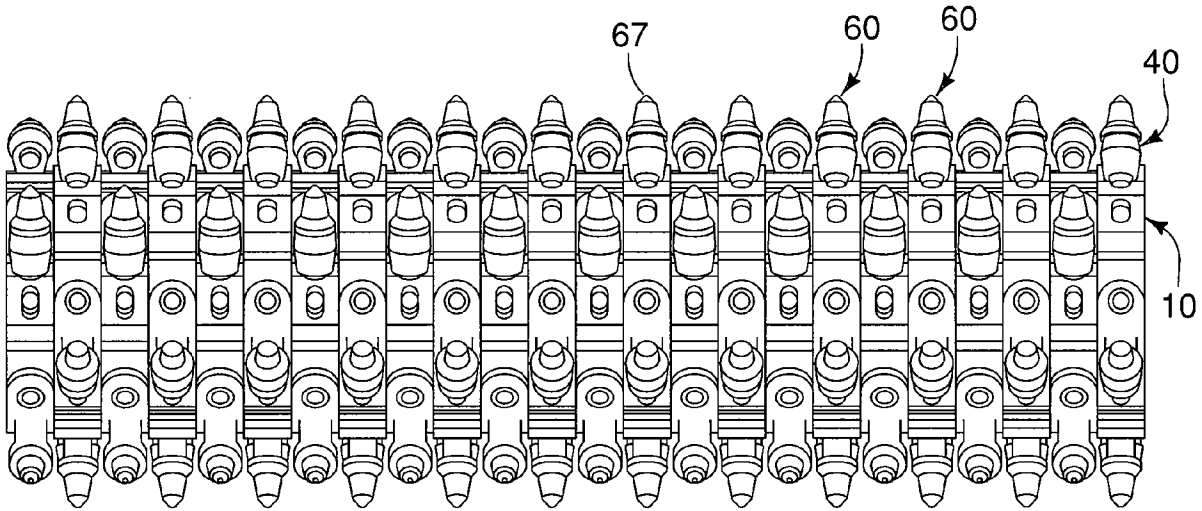
FIG. 8 is an orthographic side view of an arbor carrying a first configuration of plural replaceable tool holders and carbide tipped impact tools that is suitable for milling abrasive materials.
Figure 9:
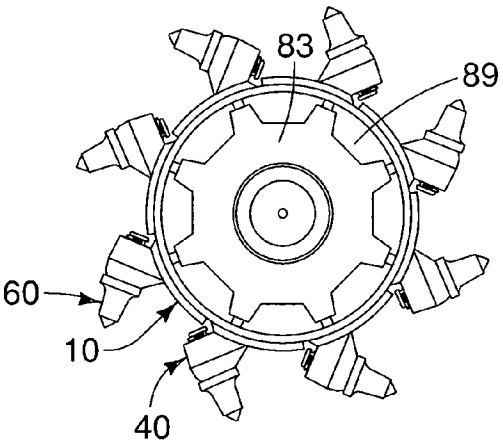
FIG. 9 is an orthographic end view of the arbor of FIG. 8 showing how the arbor protector bases engage with axially aligned hammer channels defined in the arbor.
Figure 10:
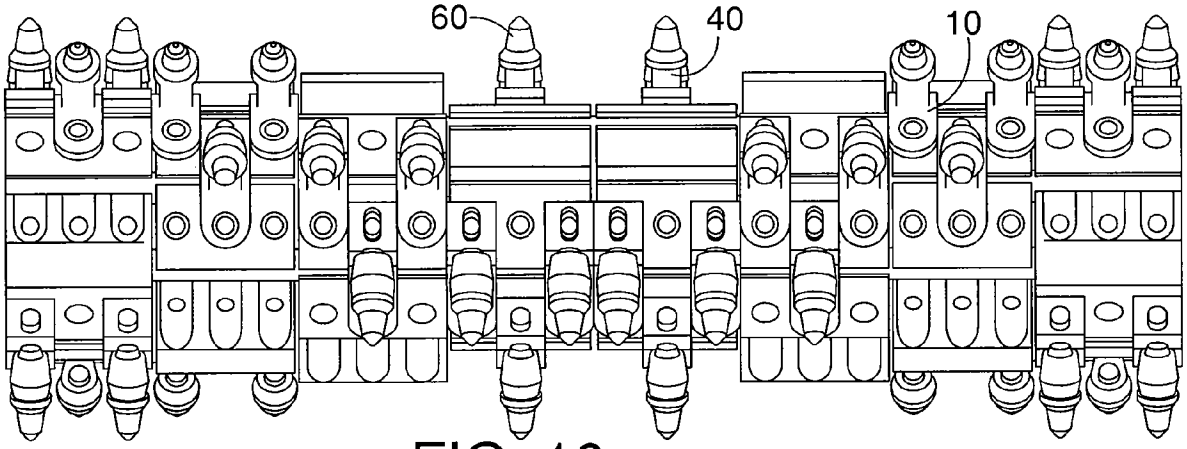
FIG. 10 is an orthographic side view of an arbor, similar to that of FIG. 8 showing a second configuration of plural replaceable tool holders and carbide tipped impact tools that is suitable for fracturing hard materials such as concrete.
Figure 12:
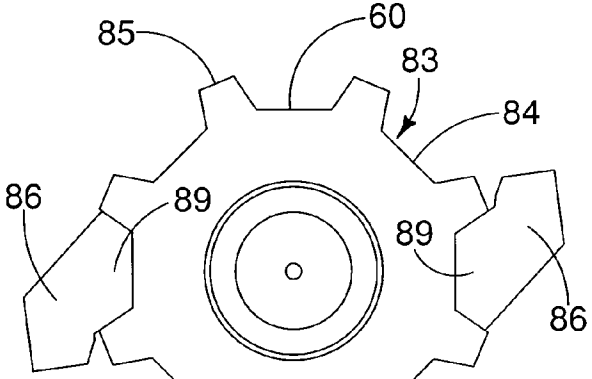
FIG. 12 is an enlarged orthographic end view of an arbor showing the axially aligned hammer channels and the engagement of the frustro-conical base portions of the arbor protectors in the hammer channels.
Figure 11:
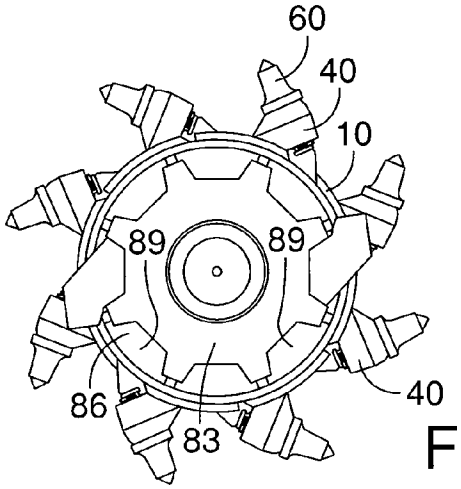
FIG. 11 is an orthographic end view of the arbor of FIG. 10.
Figure 13:
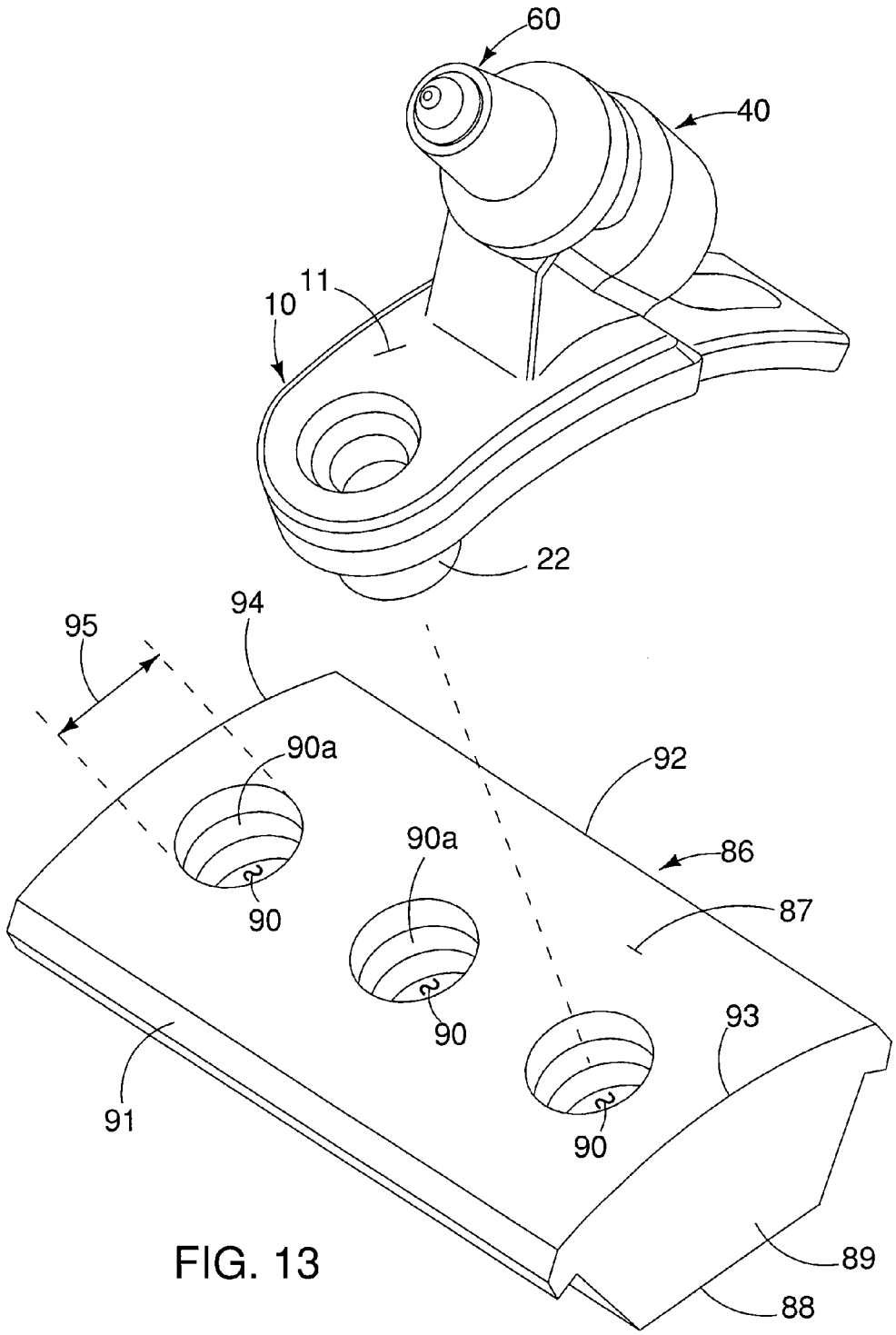
FIG. 13 is an isometric leading end, top and first side view of our replaceable tool holder positioned above and aligned with an arbor protector showing how the bolt bushing engages with the countersunk bolt hole defined in the arbor protector.
Figure 14:
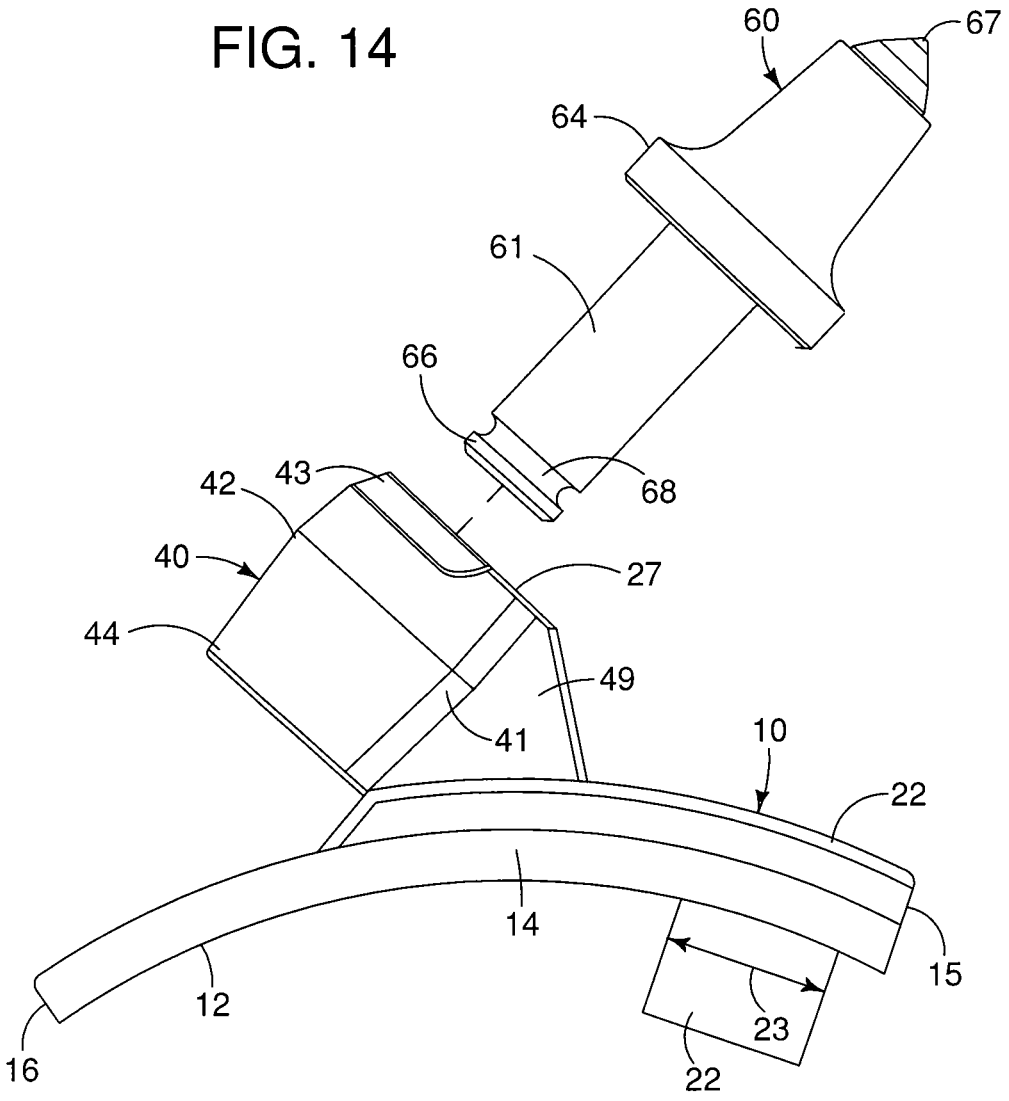
FIG. 14 is an orthographic second side view, similar to that of FIG. 3, showing the impact tool removed from the tool holder.

In a first preferred embodiment, the replaceable arbor tool holder mounts upon an arbor protector 86 (FIG. 12). The arbor protector 86 has a generally rectilinear periphery when viewed in a plan view, and has a leading edge 91, trailing edge 92, a first lateral edge 93, a second lateral edge 94, a top portion 87 and a bottom portion 88. Plural spacedly arrayed bolt holes 90, each of which are countersunk **90*a* in the top portion 87, are defined in the arbor protector 86 extending from the top portion 87 through to the bottom portion 88 which carries a frustroconical shaped interlocking base portion 89 which mates in an axially aligned hammer channel 84 (FIG. 12) defined in an outer circumferential surface 85 of arbor 83. The countersink 90*a* of each bolt hole 90 has a diameter 95 that is larger than diameter 23 of the bolt bushing 22 which allows the bolt bushing 22 of the tool holder 40 to be axially carried within the counter sink 90*a* of the bolt hole 90 of the arbor protector 86. As shown in FIGS. 8 and 10, an arbor 83 may carry a plurality of spacedly arrayed arbor protectors 86, and a plurality of spacedly arrayed replaceable tool holders. The positioning of the front bolt hole 18 and the rear bolt hole 20 allow the tool holder bases 10 to extend across the trailing edge portion 92 of one arbor protector 86 and across the leading edge portion 91 of an adjacent arbor protector 86 for secure attachment of our replaceable tool holders to the arbor protectors 86 and to arbor 83**.

The structural interconnection of the bolt bushing 22 to the bottom surface 12 of the base 10, and the engagement of the bolt bushing 22 within the counter sink **90*a* of the bolt hole 90 of the arbor protector 86 transfers impact forces exerted on the tip 67 of the impact tool 60, as it strikes a material during rotation of the arbor 83, radially downwardly to the arbor protectors 86 thereunder which frictionally mate along leading edge portions 91 and trailing edge portions 92 of adjacent arbor protectors 86 and ultimately downwardly to the arbor 83**.

As shown in FIGS. 8 and 10 the positions of the replaceable tool holders on the arbor 83 and on arbor protectors 86 may be adjusted as desired for staggered impact tool 60 orientation depending upon the material being worked. The variability of the impact tool 60 configuration provides customization of arbors 83 and flexibility that does not otherwise exist in rock crushing and milling machines. For example, it may be desirable to grind/mill a trough in an asphalt road and the trough needs to have a certain width that may be less than the length of the arbor 83. Installing tool holders 40 with impact tools 60 on the arbor 83 in a configuration having the desired width of the desired trough may be accomplished by covering the remaining portion of the arbor 83 with arbor protectors 86 without our replaceable arbor tool holder 40. Similarly, if plural spaced apart troughs need to be milled into a surface, the tooling configuration could be similarly configured to mill the plural desired troughs without having to build a new arbor 83.

Figure 15:
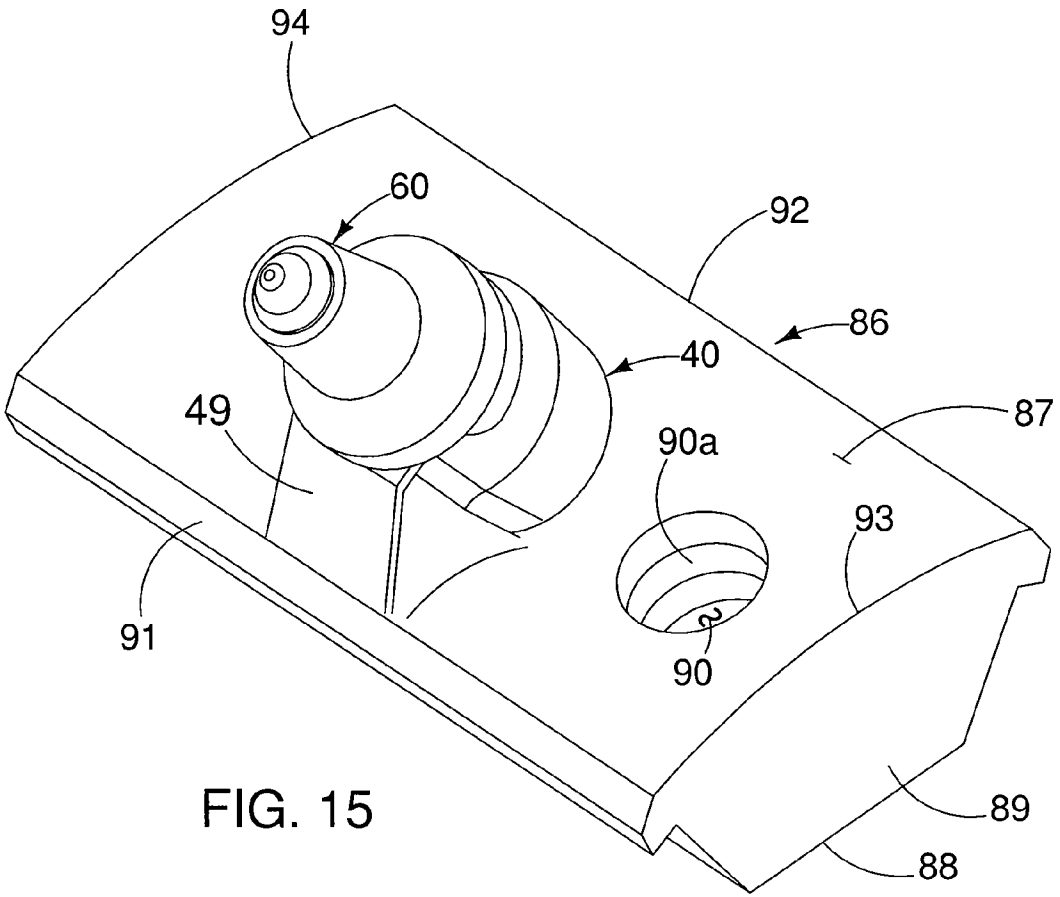
FIG. 15 is an isometric leading end, top and first side view of a second embodiment of our invention showing the tool holder structurally attached to a top surface of an arbor protector.

In a second embodiment, shown in FIG. 15, the tool holder 40 is structurally interconnected to the top portion 87 of an arbor protector 86 which is releasably attachable to the arbor 86 with plural mounting bolts 80 extending through the bolt holes 90. Structurally interconnecting the tool holder 40 to the arbor protector 86 may be desirable when extensive milling/scarifying operations are being undertaken.

Figure 16:
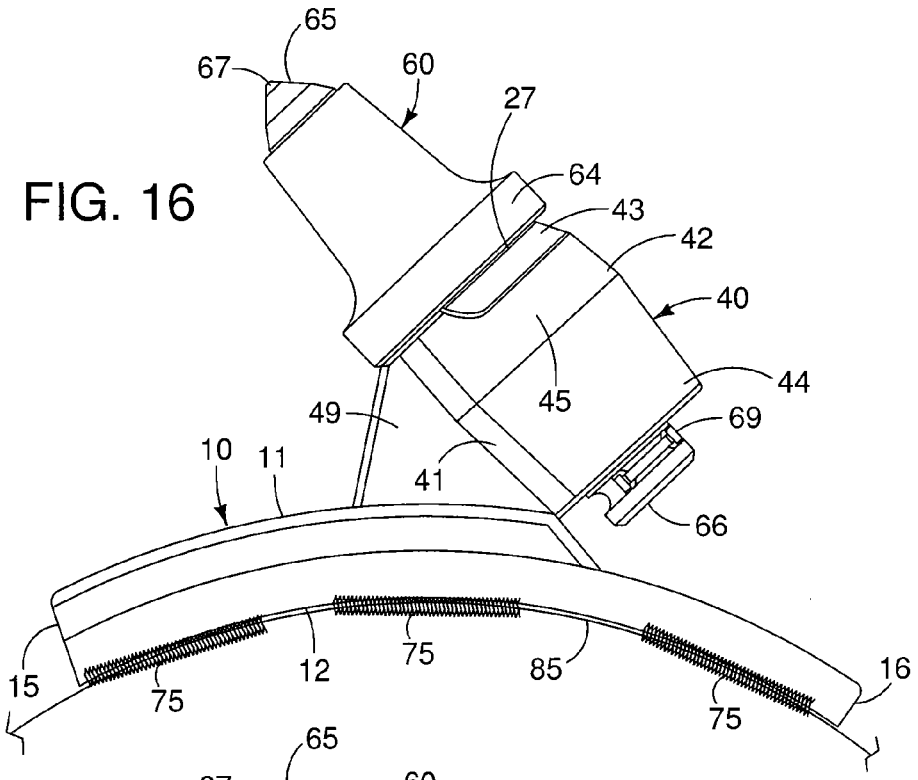
FIG. 16 is an isometric leading end, top and first side view similar to that of FIG. 1 showing of another embodiment of our replaceable tool holder welded to an outer circumferential surface of a cylindrical arbor.
Figure 17:
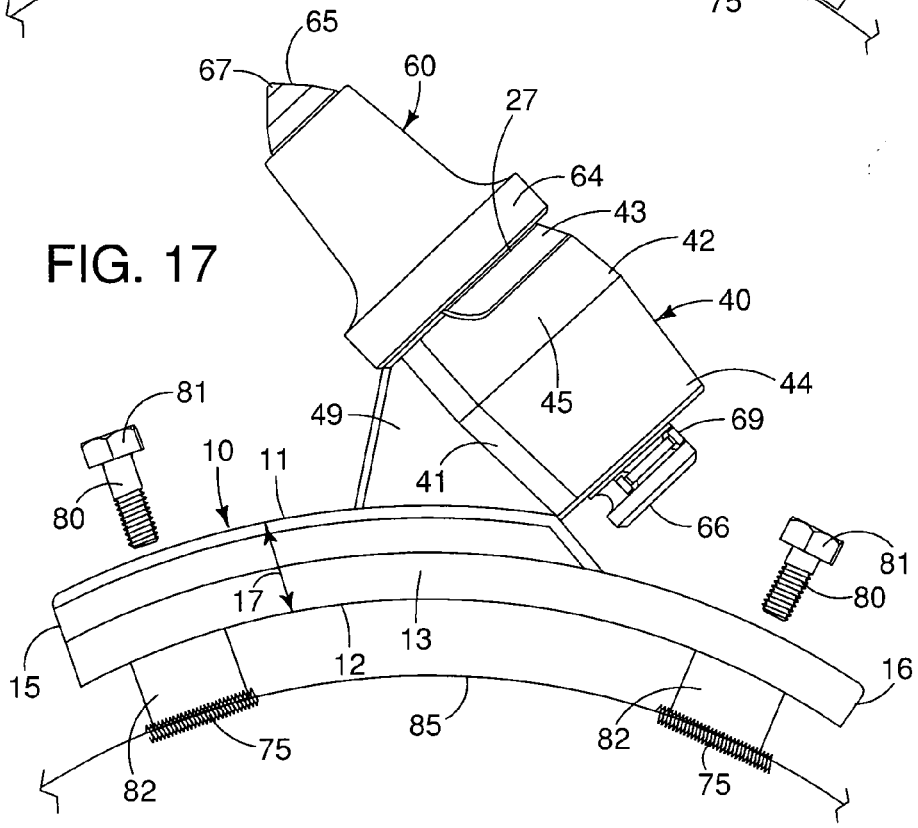
FIG. 17 is an isometric leading end, top and first side view similar to that of FIG. 16 showing the replaceable tool holder mounted to threaded sleeves welded to an outer circumferential surface of a cylindrical arbor.

In a third embodiment (FIGS. 16 and 17) the replaceable tool holder base 10 is arcuate and seats directly upon an outer circumferential surface 85 of a cylindrical arbor 83. The tool holder base 10 may be attached to the arbor 83 by means such as welding 75, which is a common means of attaching tools to arbors 83 in the industry or may be attached to the arbor 83 with mounting bolts 80 that threadably engage with radially aligned holes (not shown) defined in the arbor. In a further embodiment the tool holder base 10 may also be attached to the arbor 83 outer circumferential surface 85 by means of cylindrical threaded sleeves 82 that are welded in spaced array to the arbor 83 outer circumferential surface 85 so that mounting bolts 80 passing through the front bolt hole 18 and rear bolt hole 20 engage therewith.

Construction and Materials of the Apparatus

The base 10 and tool holder 40 are preferably integral and are preferably formed of hardened treated steel such as, but not limited to, hardened chrome steel formed by known casting or molding or forging processes such as, but not limited to sand casting. The impact tool 60 is preferably purchased off-the-shelf from known manufacturers, distributors and retailers and is also typically formed of a hardened treated steel and the tip 67 is preferably formed of carbide.

Having described the structure of our replaceable arbor tool holder for replaceable impact tools, its operation may be understood.

An arbor protector 86 is positioned immediately adjacent the arbor 83 so that the frustroconical interlocking base portion 89 of the arbor protector 86 mates in an axially extending hammer channel 84 defined in the arbor 83. The base 10 is positioned so that the bolt bushing 22 engages with and extends into the counter sink 90*a* of a bolt hole 90 defined in the arbor protector 86. A mounting bolt 80 is then inserted into the front bolt hole 18 to pass through the medial channel 26 through the bolt bushing 22 and through the arbor protector 86 to threadably engage with a threaded hole (not shown) defined in the arbor 83.

The base 10 is maneuvered so that the rear bolt hole 20 is aligned with a bolt hole 90 defined in a rearward adjacent arbor protector 86 carried on the arbor 83. A mounting bolt 80 is inserted through the rear bolt hole 20 to pass through the base 10 and through the arbor protector 86 to threadably engage in a threaded hole (not shown) defined in the arbor 83. The mounting bolts 80 are tightened accordingly so that the head portions 81 are within the counter sinks 28, 29.

An impact tool 60 is positioned so that the second end portion 66 of the shaft 61 is adjacent to the orifice (not shown) of the medial channel (not shown) defined by the tool holder 40. The second end portion 66 of the shaft 61 is inserted into the medial channel (not shown) so that the shaft 61 extends therethrough and shank 64 frictionally rests upon the shoulder 27 of the tool holder 40. The C-ring retaining ring 69 is thereafter engaged with the retainer ring groove 68 defined in the circumferential surface of the second end portion 66 of the shaft 61.

The process for installing additional tool holders and impact tools 60 is repeated along the arbor 83 as desired to create the desired configuration of impact tooling, such as is shown in FIG. 8 and FIG. 10.

After a period of use whereupon the impact tools 60 may become worn and less effective, the impact tools 60 may simply be replaced by removing the C-ring retainers 69 from the retainer ring groove 68 and the impact tool 60 from the tool holder 40 and thereafter reinstalling a new impact tool 60 in the tool holder 40.

The foregoing description of our invention is necessarily of a detailed nature so that a specific embodiment of a best mode may be set forth as is required, but it is to be understood that various modifications of details, and rearrangement, substitution and multiplication of parts may be resorted to without departing from its spirit, essence or scope.

Interpretation Notes

The above description has set out various features, functions, methods and other aspects of our invention. This has been done with regard to the currently preferred embodiments thereof. Time and further development may change the manner in which the various aspects are implemented. Such aspects may further be added to by the language of the claims which are incorporated herein by this reference. The scope of protection accorded our invention, as defined by the claims, is not intended to be necessarily limited to the specific sizes, shapes, features or other aspects of the currently preferred embodiment shown and described. The claimed invention may be implemented or embodied in other forms still being within the concepts shown, described and claimed herein. Also included are equivalents of the invention which can be made without departing from the scope or concepts properly protected hereby.

The foregoing description of our invention is necessarily of a detailed nature so that a specific embodiment of a best mode may be set forth as is required, but it is to be understood that various modifications of details, sizes, and rearrangement, substitution and multiplication of the parts may be resorted to without departing from its spirit, essence or scope.

Having thusly described our invention, we hereby file this Utility Patent Application.

The invention claimed is:

1. An apparatus for carrying an impact tool for rock crushing, grinding, scarifying and milling operations, the apparatus comprising:

a rotatable arbor having an external surface;

an arbor protector having a top portion and an opposing bottom portion that is sized and shaped to bear against the external surface of the routable arbor, and a plurality of openings extending through the arbor protector from the top portion to the bottom portion and sized and shaped to receive fasteners to removably attach the arbor protector to the arbor in which the fasteners are radially oriented with respect to the rotatable arbor;

an impact tool holder that includes:

a base having a top portion, a bottom portion, a leading end portion and a trailing end portion, the base configured for releasable attachment of its bottom portion to the top portion of the arbor protector;

a first bolt hole extending through the base, the first bolt hole located adjacent the leading end portion;

a bushing attached to and extending from the bottom portion of the base adjacent the leading end portion of the base, the bushing having a longitudinal axial bore extending therethrough and in communication with the first bolt hole, the bushing sized and shaped to be received in and engage one of the plurality of openings extending through the arbor protector and to have the longitudinal axial bore of the bushing radially oriented with respect to the arbor to transfer impact forces exerted on the impact tool that are normal to the longitudinal axial bore of the bushing into a direction that is radially through the arbor protector and to the arbor as the tool strikes material during rotation of the arbor; and a tool holder structurally connected to the top portion of the base and configured to releasably carry the impact tool for rock crushing, grinding, scarifying and milling operations.

2. The apparatus of claim 1 further comprising a second bolt hole extending through the base and located adjacent the trailing end portion of the base.

3. The apparatus of claim 2 wherein the tool holder is centrally disposed on the top portion of the base and located between the first and second bolt holes.

4. The apparatus of claim 3 further comprising: a gusset communicating between the top portion of the base and the tool holder.

5. The apparatus of claim 1 wherein the bushing has a generally cylindrical shape having a generally flat end surface distal to the bottom portion of the base.

6. The apparatus of claim 1 wherein the base is convex on the top portion.

7. The apparatus of claim 1 wherein the base is concave on the bottom portion.

* * * * *